US005793304A

United States Patent [19]

Sone

[11] Patent Number: 5,793,304

[45] Date of Patent: Aug. 11, 1998

[54] RADIO SELECTIVE CALLING RECEIVER THAT USES COLOR INDICATORS TO IDENTIFY DUPLICATE MESSAGES

[75] Inventor: Tomoshi Sone, Shizuoka, Japan

[73] Assignee: NEC Corporation, Tokyo, Japan

[21] Appl. No.: 684,315

[22] Filed: Jul. 19, 1996

[30] Foreign Application Priority Data

Jul. 21, 1995 [JP] Japan ..... 7-185154

[51] Int. Cl.[6] ..... G08B 5/22

[52] U.S. Cl. ..... 340/825.44; 345/88

[58] Field of Search ..... 340/825.44; 345/83, 345/88, 150; 349/108

[56] References Cited

U.S. PATENT DOCUMENTS

| | | | |
|---|---|---|---|
| 4,673,252 | 6/1987 | Kugo et al. | 345/88 |
| 4,975,694 | 12/1990 | McLaughlin | 340/825.44 |
| 5,347,269 | 9/1994 | Vanden Heuvel et al. | 340/825.44 |

FOREIGN PATENT DOCUMENTS 1286532 11/1989 Japan .

9103885 3/1991 WIPO .

OTHER PUBLICATIONS

Motorola Instruction Manual 68P810 48C 80–A, Oct., 1990, pp. 1–5.

Motorola Watch Pager Brochure, 1990, pp.1–6.

*Primary Examiner*—Brian Zimmerman
*Assistant Examiner*—Edward Merz
*Attorney, Agent, or Firm*—Whitham, Curtis & Whitham

[57] ABSTRACT

A selective calling receiver previously stores a plurality of visual patterns which are different in area from each other on screen. A counter function counts the number of times a single message was received for a predetermined period and then, according to the number of times the single message was received, a single visual pattern is selected from the stored visual patterns. The single message is displayed with the single visual pattern on screen. The visual pattern is preferably displayed with a selected attribute such as color and/or blinking cycle which are determined according to the number of times the single message was received.

45 Claims, 7 Drawing Sheets

FIG.2
AREA PATTERN TABLE
| REFERENCE | VISUAL PATTERN | COLOR |
|---|---|---|
| X=1 | $VPA_1$ | BLUE |
| X=2 | $VPA_2$ | GREEN |
| X=3 | $VPA_3$ | RED |
FIG.3A
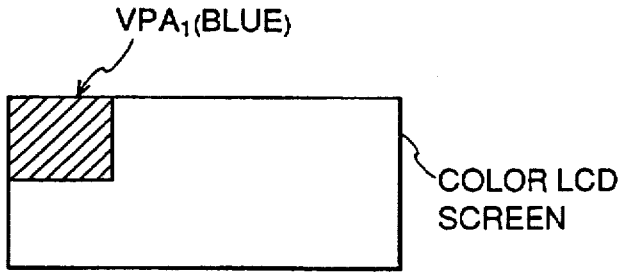
FIG.3B
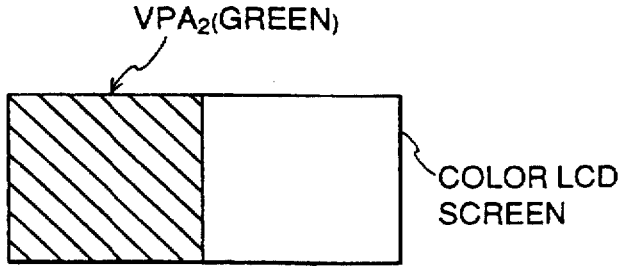
FIG.3C
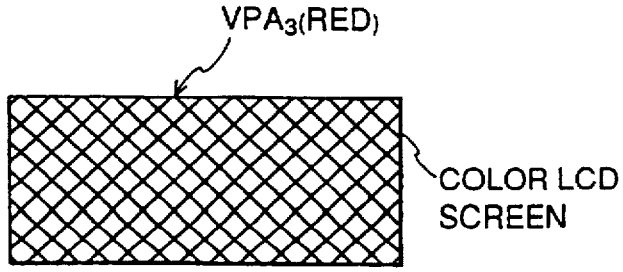

RADIO SELECTIVE CALLING RECEIVER THAT USES COLOR INDICATORS TO IDENTIFY DUPLICATE MESSAGES

BACKGROUND OF THE INVENTION

1. Field of the Invention

The present invention generally relates to a radio selective calling receiver which is provided with a display, and in particular to a visually notifying method and system for notifying a user of information through the display.

2. Description of the Related Art

A selective calling receiver has been widely used for various purposes and, especially, a small-sized and light-weight selective calling receiver called a pager is suitable for being taken on the road. A basic function of the selective calling receiver is to indicate by beep sound, vibration, or light the incoming call and then to display a received message on an liquid-crystal display (LCD) according to the user's key operation.

Some selective calling receivers are provided with an LED (light-emitting diode) blinking circuit which is used as a visually notifying device. The LED blinking circuit is comprised of an LED and a step-up coil which are connected in parallel. The step-up coil is used to boost the voltage across the LED, which causes the LED to blink on and off.

A typical visually notifying device is a display device such as an LCD device. A paging receiver having a color LCD which is used as the visually notifying device is disclosed in Japanese Patent Laid-open Publication No. 1-286532. This paging receiver is provided with a controller which controls the displaying color of a received message depending on the contents of the received message, the elapsed time after the message has been received, or the number of times that the same message is repeatedly received.

However, the LED blinking circuit needs a large power consumption when driving the LED on and off, which will be a heavy burden for a small-capacity battery mounted in a pager. Further, electromagnetic noises occurring when the voltage is boosted by the set-up coil may adversely affect the characteristics of a radio system provided in the pager. Furthermore, since the LED blink can be visible only within a very restricted area, the sufficient amount of information cannot be provided to the user.

On the other hand, the paging receiver having a color LCD which is used as the visually notifying device has the advantage that the user can obtain a larger amount of information through the color LCD. However, the paging receiver determines the displaying color of a received message depending on the contents of the received message, the elapsed time after the message has been received, or the number of times that the same message is repeatedly received. Since the color does not directly represent any quantity, it is difficult for the user to understand the degree of importance of the received message at a glance.

SUMMARY OF THE INVENTION

An object of the present invention is to provide a displaying method which allows the user to understand the information displayed on screen at a glance.

Another object of the present invention is to provide a displaying method which notifies the user of a received message as well as the information associated with the received message in easy-to-understand image on screen.

Still another object of the present invention is to provide a selective calling receiver which forms an easy-to-understand image on screen so that the user understands the degree of importance of the information.

According to an aspect of the present invention, a plurality of visual patterns which are different in area from each other on screen are previously stored. The number of times a single message was received for a predetermined period is counted and then, according to the number of times the single message was received, a single visual pattern is selected from the stored visual patterns. The single message is displayed with the single visual pattern on screen.

The visual patterns have different areas on screen ranging from a predetermined fraction of a full screen area of the display device to the full screen area. Preferably, the single visual pattern having the predetermined fraction of the full screen area is selected when the single message is received for the first time, the single visual pattern having a larger fraction of the full screen area is selected as the number of times the single message was received becomes larger, and the single visual pattern having the full screen area is selected when the number of times the single message was received is equal to or greater than a predetermined number. In order to simplify a display image, each of the visual patterns preferably has a rectangular shape to be displayed on screen.

According to another aspect of the present invention, the selective calling receiver previously stores a predetermined number of visual patterns which are different in area from each other on screen and the predetermined number of different attributes corresponding to the visual patterns, respectively. According to the number of times a single message was received for a predetermined period, a single visual pattern and a single attribute corresponding to the single visual pattern are selected. The single message and the single visual pattern are displayed with the single attribute on screen.

More specifically, the attributes preferably include different colors from which a single color is selected according to the number of times the single message was received, and wherein the single message is displayed with the single visual pattern of the single color on screen. Further, the single message may be displayed with the single visual pattern blinking according to the single attribute on screen.

The attributes preferably include different blinking cycles from which a single blinking cycle is selected according to the number of times the single message was received, and the single message is displayed with the single visual pattern blinking in the single cycle on screen. More preferably, the attributes have different blinking cycles on screen ranging from a first blinking cycle to a second blinking cycle shorter than the first blinking cycle. In this case, the single visual pattern having the first blinking cycle is selected when the single message is received for the first time, the single visual pattern having a shorter blinking cycle is selected as the number of times the single message was received becomes larger, and the single visual pattern having the second blinking cycle is selected when the number of times the single message was received is equal to or greater than a predetermined number.

It is further preferable that the attributes include different colors and different blinking cycles from which a single color and a single blinking cycle are selected according to the number of times the single message was received, and that the single message is displayed with the single visual pattern of the single color blinking in the single cycle on screen.

As described above, according to the present invention, a received message is displayed on screen together with the visual pattern whose area is determined according to the reception times that message was received for the predetermined period. Therefore, the user can understand the information including the degree of importance of the received message displayed on screen at a glance.

Further, a received message is displayed on screen together with the visual pattern and its attribute which are determined according to the reception times that message was received for the predetermined period. Therefore the user can understand more easily the information including the degree of importance of the received message displayed on screen.

BRIEF DESCRIPTION OF THE DRAWINGS

FIG. 2 is a schematic diagram showing an example of the contents of an area pattern table provided in the embodiment of FIG. 1;

FIG. 3A is a schematic diagram showing a visual pattern displayed on screen when a message is received for the first time in a first embodiment of a visually notifying method according to the present invention;

FIG. 3B is a schematic diagram showing a visual pattern displayed on screen when the same message is received two times in the first embodiment;

FIG. 3C is a schematic diagram showing a visual pattern displayed on screen when the same message is received three or more times in the first embodiment;

DETAILED DESCRIPTION OF THE PREFERRED EMBODIMENTS

Figure 1:
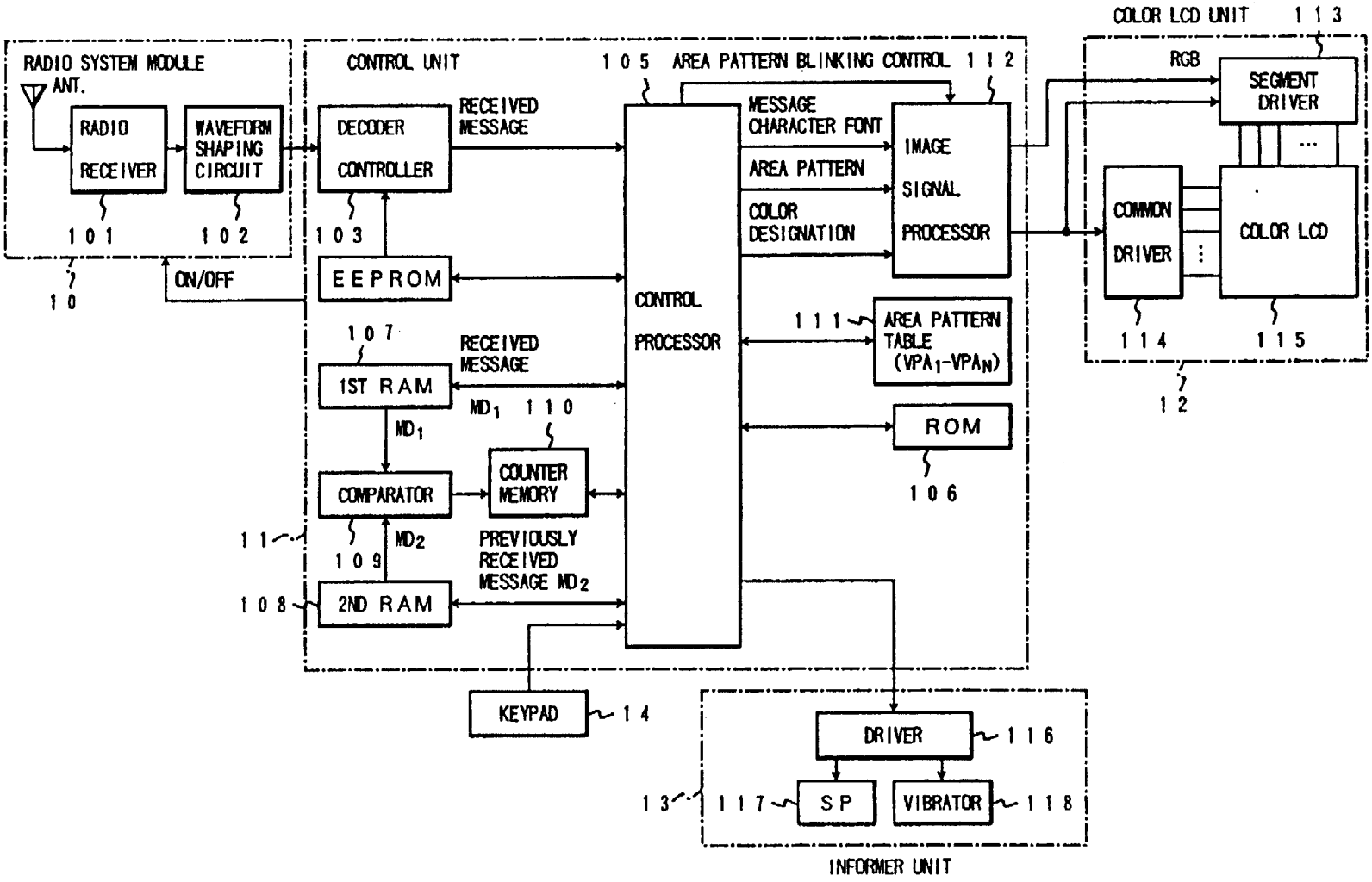
FIG. 1 is a block diagram showing the functional arrangement of an embodiment of a radio selective calling receiver according the present invention.

Referring to FIG. 1, a radio selective calling receiver is comprised of a radio system module 10, a control unit 11, a color LCD unit 12, an informer unit 13, and an input keypad. The radio system module 10 is comprised of a built-in antenna, a radio receiver 101, and a waveform shaping circuit 102. The radio receiver 101 receives a digital-modulated radio signal from a radio base station (not shown) of a selective calling system through the built-in antenna. The radio receiver 101 further includes a digital demodulator which demodulates the received radio signal into a baseband signal. After the waveform of the baseband signal is shaped by the waveform shaping circuit 102, the wave-shaped signal is transferred as a selective calling signal from the radio system module 10 to a decoder controller (or communication controller) 103 of the control unit 11.

The decoder controller 103 receives the selective calling signal from the waveform shaping circuit 102 and decodes it into received data. In this embodiment, the decoder controller 103 further compares the selective calling number included in the received data with the identification (ID) number previously stored in an EEPROM (electrically-erasable programmable read only memory) 104 under the control of a control processor 105. The control processor 105 uses a operating program and other function programs stored in a program ROM 106 to perform the operation control of the selective calling receiver. The program ROM 106 further stores a set of characters or a font for displaying messages on screen.

When the selective calling number included in the received data is identical to the ID number, the decoder controller 103 outputs a received message $MD_1$, included in the received data to a first random access memory (RAM) 107 under the control of the control processor 105.

A predetermined number of previously received messages have been stored in a second RAM 108, and the previously received messages are compared one by one to the received message $MD_1$, by a comparator 109. In other words, the second RAM 108 is searched for the received message $MD_1$. When the received message $MD_1$ is the same as a single message $MD_2$ of the previously received messages, the comparator 109 outputs a logical value of 1 to a counter corresponding to the message $MD_2$ stored in a counter memory 110, otherwise a logical value of 0. The corresponding counter is incremented each time receiving the logical value of 1 from the. comparator 109, that is, each time the received message $MD_1$ is determined to be the same as the previously received message $MD_2$ by the comparator 109. Therefore, the counter memory 110 stores count values corresponding to the previously received messages, respectively, each count value indicating the number of times that message was received. Each counter of the counter memory 110 is reset at predetermined intervals by the control processor 105 using a timer (not shown). The comparator 109 is preferably implemented in program by the control processor 105 using the operating program stored in the program ROM 106.

Figure 8A:
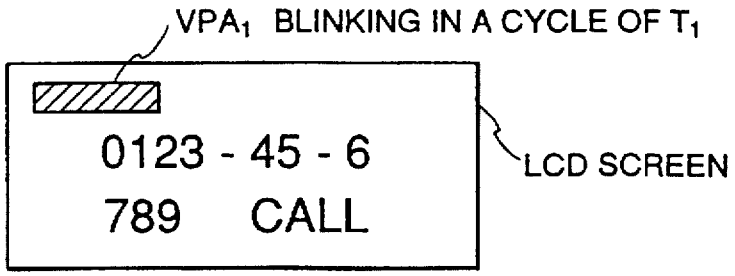
FIG. 8A is a schematic diagram showing the display screen when a message is received for the first time according to the second embodiment.
Figure 8B:
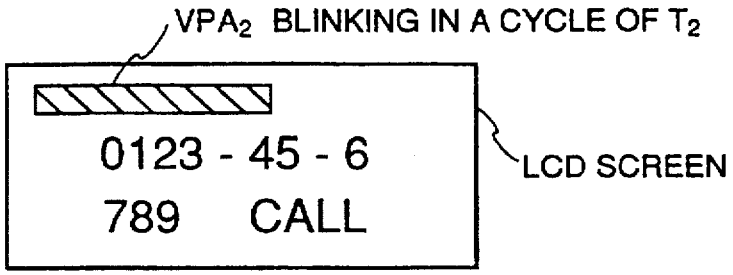
FIG. 8B is a schematic diagram showing the display screen when the same message is received two times according to the second embodiment.
Figure 8C:
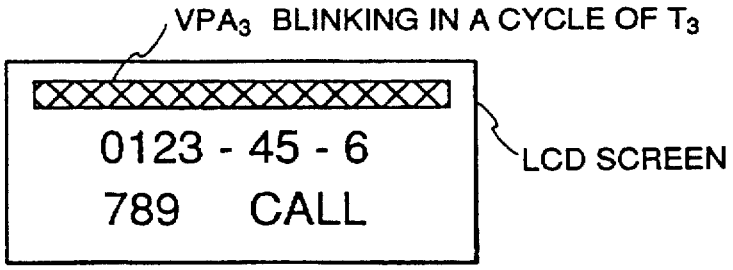
FIG. 8C is a schematic diagram showing the display screen when the same message is received three or more times according to the second embodiment.

An area pattern table 111 stores in advance a plurality of visual area patterns $VPA_1$–$VPA_n$ and information related to the respective visual area patterns $VPA_1$–$VPA_n$. In an embodiment of the present invention, three visual area patterns $VPA_1$–$VPA_3$ and three different colors as relational information are previously stored in the area pattern table 111, as shown in FIGS. 2 and 3A–3C. In another embodiment of the present invention, the relational information includes three different blinking cycles $T_1$–$T_3$ associated with the respective visual area patterns $VPA_1$–$VPA_3$ as shown in FIGS. 8A–8C. Needless to say, the relational information may include three different colors and three different blinking cycles $T_1$–$T_3$ associated with the respective visual area patterns $VPA_1$–$VPA_3$.

The control processor 105 checks a count value of the counter memory 110, and then selects a visual area pattern and its relational information in accordance with the count value, which will be described in detail later. The selected visual area pattern and its relational information are transferred to an image signal processor 112 together with a message character font which is read from the program ROM 106 in accordance with the received message $MD_1$. The image signal processor 112 generates display color control signals and a timing signal to a segment driver 113 and a common driver 114, Which cause a color LCD device 115 to display the received message with the selected visual area pattern on screen. As described later, the control processor 105 allows the selected visual area pattern on screen to blink in a predetermined cycle corresponding to the selected visual area pattern.

When the selective calling number included in the received data is identical to the ID number, as described before, the control processor 105 controls the image signal processor 112 so as to display the received message with the selected visual area pattern on screen and, at the same time, controls a driver 116 of the informer unit 13 such that a speaker 117 makes a beep or that a vibrator 118 generates vibration for notifying the user of the incoming call. when the user is aware of an incoming call through the speaker 117 or the vibrator 118, the user manually operates the keypad 14 to stop the informer unit 13 working. By the user pressing the keypad to read a received message, the received message is displayed with the selected visual area pattern on screen.

As illustrated in FIG. 2 and FIGS. 3A–3C, in this embodiment, the area pattern table 111 contains data of three visual area patterns $VPA_1$–$VPA_3$ and three different colors (blue, green, and red). The first visual area pattern $VPA_1$ in blue is selected when a new message was received. The area of the first visual area pattern $VPA_1$ is one-eighth the full screen as shown in FIG. 3A. The second visual area pattern $VPA_2$, in green is selected when the same message was received twice. The area of the second visual area pattern $VPA_2$ is a half the full screen as shown in FIG. 3B. The third visual area pattern $VPA_3$ in red is selected when the same message was received three or more times. The area of the third visual area pattern $VPA_3$ is equal to the full screen as shown in FIG. 3C. Needless to say, the present invention is not restricted to the above colors and the area ratios of the visual area pattern to the full screen. Any color including monochrome and any area ratio may be determined so that the user can understand the degree of importance or the number of times the same message was received at a glance.

Further, the area pattern table 111 preferably contains data of three visual area patterns $VPA_1$–$VPA_3$, three different colors (blue, green, and red), and three different cycles. A selected one of the visual area patterns $VPA_1$–$VPA_3$ blinks on and off according to the corresponding cycle. For example, the larger the reference number X, the shorter the cycle.

The image signal processor 112 combines the message with the selected visual area pattern corresponding to the number of times the message was received.

Figure 4A:
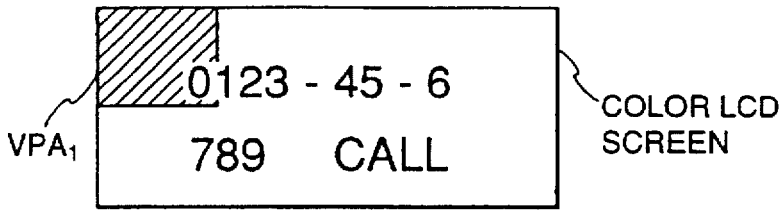
FIG. 4A is a schematic diagram showing the display screen when a message is received for the first time according to the first embodiment.
Figure 4B:
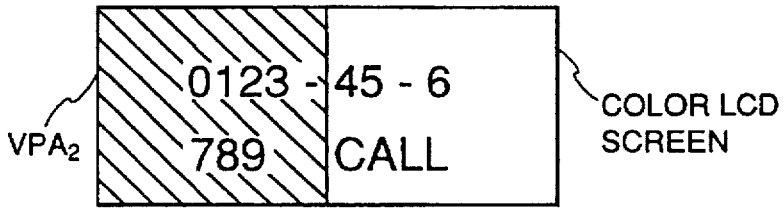
FIG. 4B is a schematic diagram showing the display screen when the same messages received two times according to the first embodiment.
Figure 4C:
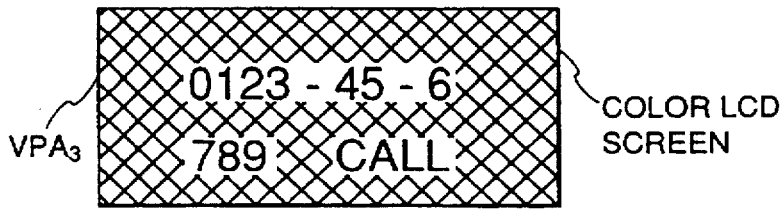
FIG. 4C is a schematic diagram showing the display screen when the same message is received three or more times according to the first embodiment.

As shown in FIG. 4A, a message "0123-45-6789 CALL" is displayed with the first visual area pattern $VPA_1$ of blue when the message was received for the first time. The areas other than the message and the first visual area pattern $VPA_1$ are made bleached-looking. When the message was received twice, as shown in FIG. 4B, the message "0123-45-6789 CALL" is displayed with the second visual area pattern $VPA_2$ of green. Similarly, when the message was received three times or more, as shown in FIG. 4C, the message "0123-45-6789 CALL" is displayed with the third visual area pattern $VPA_3$ of red.

Figure 5:
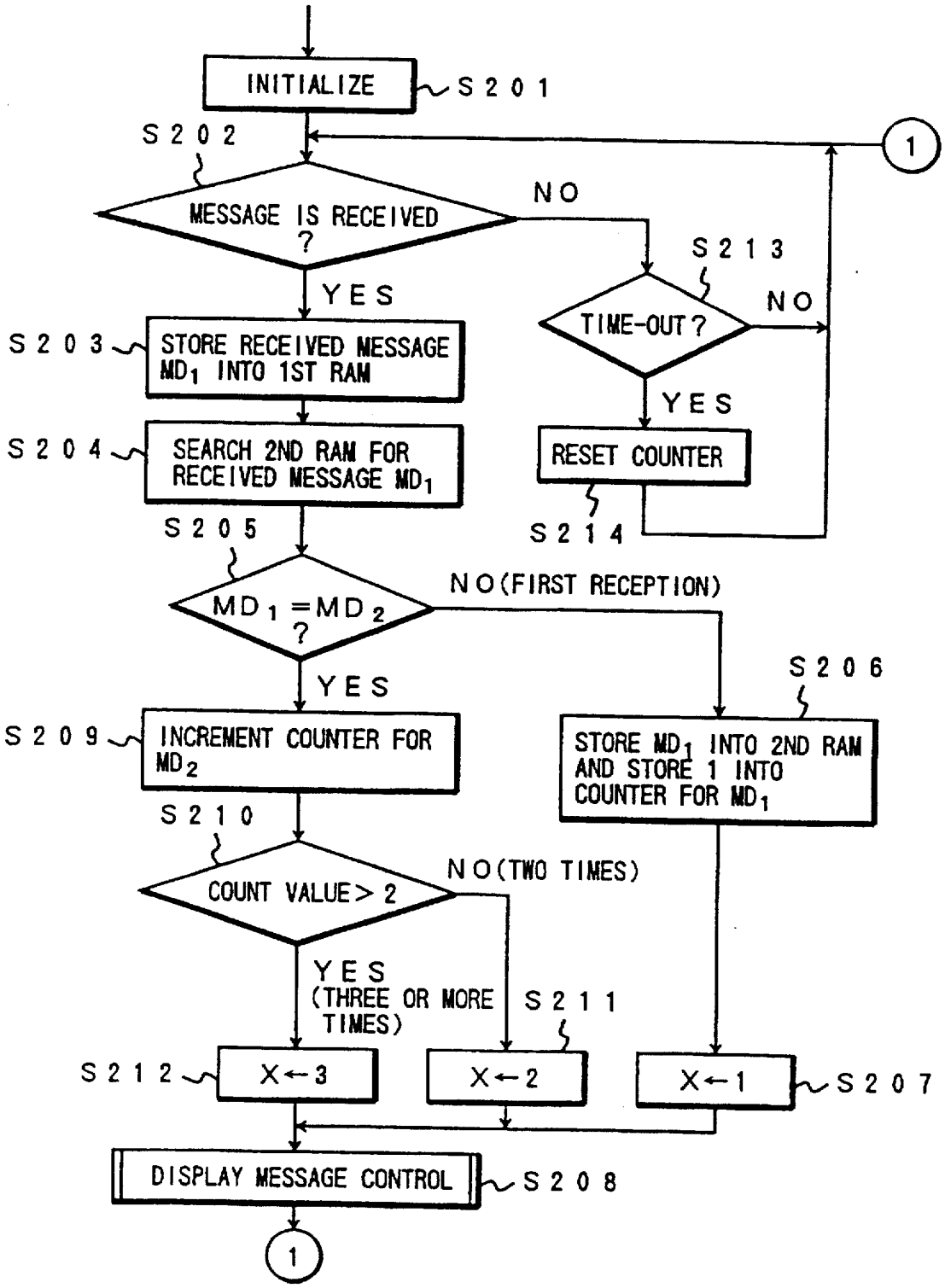
FIG. 5 is a flowchart showing a main routine of a visually notifying method according to the present invention.

Referring to FIG. 5, wherein the comparator 109 is implemented in the control processor 105 executing the operating program, after initializing the counter memory 110 and other variables including X (step S201), the control processor 105 checks whether any message is received from the decoder controller 103 (step S202). When any message is received, that is, an incoming call interrupt occurs (YES in step S202), the control processor 105 causes the received message $MD_1$ to be stored into the first RAM 107 (step S203). While reading the previously received messages one by one from the second RAM 108, the comparator 109 compares it to the received message $MD_1$ (steps S204 and S205).

When the received message $MD_1$ is not found in the second RAM 108 (NO in step S205), which means that the message $MD_1$ was received for the first time, the message $MD_1$ is stored into the second RAM 108 and its count value of 1 is stored into a counter for the message $MD_1$ (step S206). Then the variable x is set to 1 (step S207), and the display message control is performed as described later (step S208).

When there is a previously received message $MD_2$ identical to the received message $MD_1$ (YES in step S205), the counter corresponding to that previously received message $MD_2$ is incremented (step S209) and then it is checked whether its count value is greater than 2 (step S210). If the count value of the counter is not greater than 2, then the variable X is set to 2 since the message $MD_1$ was received twice (step S211). If the count value of the counter is greater than 2, then the variable X is set to 3 since the message $MD_1$ was received three or more times (step S212). The display message control routine S208 performs the message displaying in accordance with the variable X as shown in FIGS. 4A–4C and 8A–8C.

When no message is received (NO in step S202), the control processor 105 checks whether a predetermined time period has elapsed (step S213). When the time-out occurs (YES in step S213), the counter memory 110 is reset (step S214) and then control returns to the step S202. The steps 202, 213 and 214 are repeated until any message is received (step S213).

Figure 6:
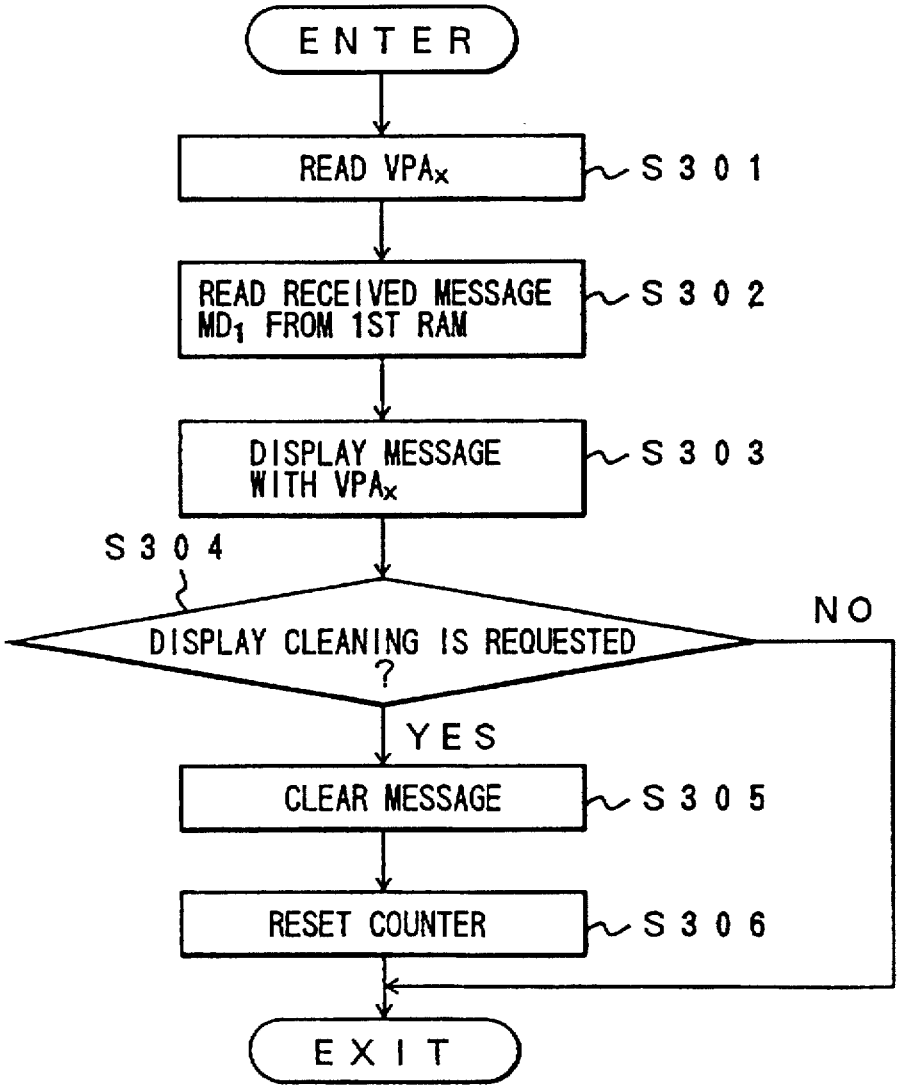
FIG. 6 is a flowchart showing a display message control routine which displays a received message and a determined visual pattern on screen according to the first embodiment shown in FIGS. 4A–4C.

Referring to FIG. 6, the control processor 105 reads one visual area pattern VPAx and its relational color which are selected according to the variable X (step S301). Subsequently, the control processor 105 reads the received message $MD_1$from the first RAM 107 (step S302) and transfers the received message $MD_1$, the selected VPAx, and the color designation to the image signal processor 112. Thus, the received message $MD_1$ is displayed with the selected VPAx of the designated color on screen (step S303), which is shown in FIGS. 4A–4C. When the user operates the keypad 14 for clearing the message $MD_1$ (YES in step S304), the control processor 105 controls the image signal processor 112 to clear the message on screen (step S305) and resets the counter (step S306) before control returning to the step S202 of FIG. 5. When clearing the message $MD_1$ is not requested (NO in step S304), control is directly transferred to the step S202.

Figure 7:
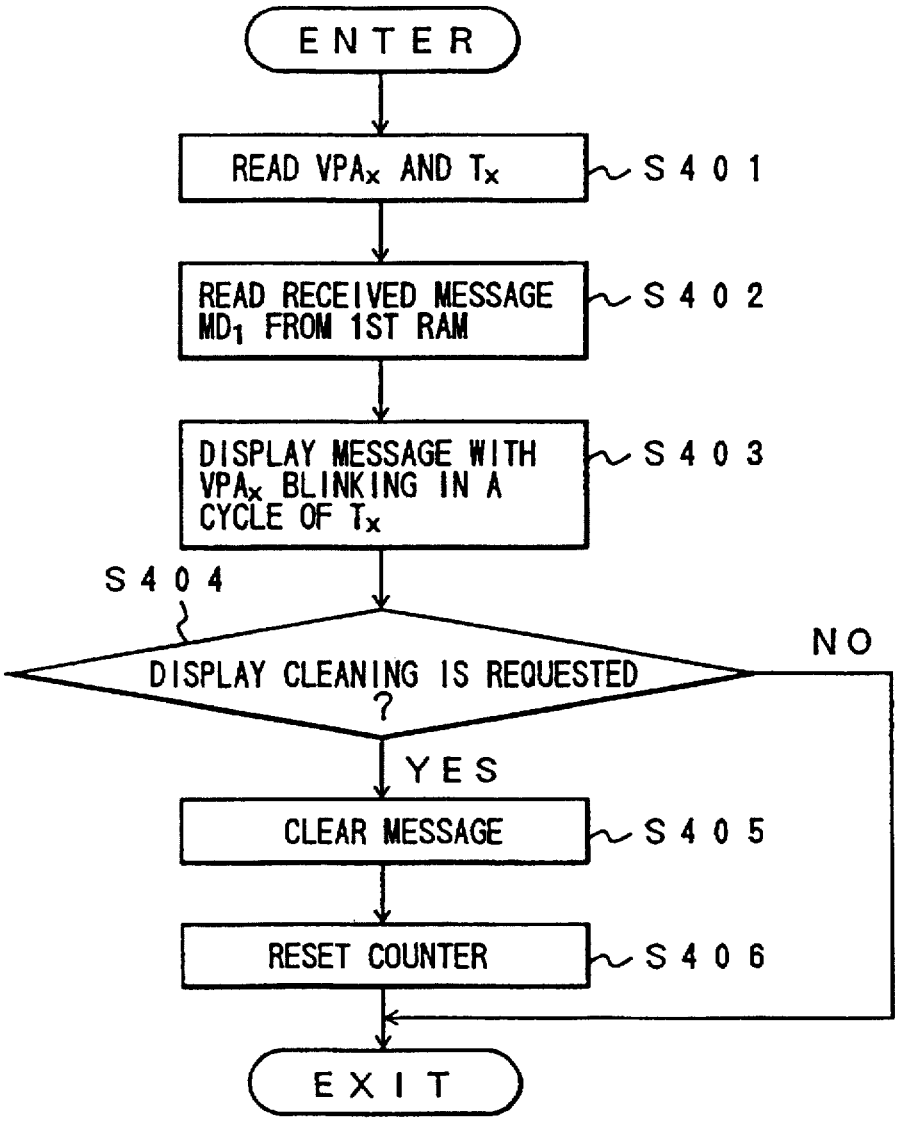
FIG. 7 is a flowchart showing another display message control routine which displays a received message and a determined visual pattern blinking in a determined cycle on screen in a second embodiment of a visually notifying method according to the present invention.

Referring to FIG. 7, the control processor 105 reads one visual area pattern VPAx and its relational color and cycle Tx which are selected according to the variable X (step S401). Subsequently, the control processor 105 reads the received message $MD_1$ from the first RAM 107 (Step S402)

and transfers the received message $MD_1$, the selected area pattern VPAx, and the color designation to the image signal processor 112. Further, the control processor 105 controls the image signal processor 112 so that the selected area pattern VPAx blinks in the cycle of TX. Thus, the received message $MD_1$ is displayed with the selected VPAx of the designated color blinking in the cycle of Tx on screen (step S403), which is shown in FIGS. 8A–8C. When the user operates the keypad 14 for clearing the message $MD_1$ (YES in step S404), the control processor 105 controls the image signal processor 112 to clear the message on screen (step S405) and resets the counter (step S406) before control returning to the step S202 of FIG. 5. When clearing the message $MD_1$ is not requested (NO in step S404), control is directly transferred to the step S202.

As shown in FIG. 8A, a message "0123-45-6789 CALL" is displayed with the first visual area pattern $VPA_1$ of blue blinking in the cycle of $T_1$ when the message was received for the first time. when the message was received twice, as shown in FIG. 8B, the message "0123-45-6789 CALL" is displayed with the second visual area pattern $VPA_2$ of green blinking in the cycle of $T_2$. Similarly, when the message was received three or more times, as shown in FIG. 8C, the message "0123-45-6789 CALL" is displayed with the third visual area pattern $VPA_3$ of red blinking in the cycle of $T_3$. In this embodiment, since the visual area pattern VPAx does not overlap the received message $MD_1$, it is not necessarily colored on screen. But it is true that colored visual area patterns are more effective at notifying the user of the degree of importance of the received message. Further, in order to display an easy-to-understand image on screen, not only the length but also the width of a visual area pattern may vary in accordance with the number of times the same message was received.

What is claimed is:

1. A method for displaying information on screen in a selective calling receiver having a display device, comprising the steps of:

preparing a plurality of visual patterns which are different in area from each other on screen;

counting number of times a single message was received for a predetermined period;

selecting a single visual pattern from the visual patterns according to the number of times the single message was received for the predetermined period; and displaying the single message with the single visual pattern on screen.

2. The method according to claim 1, wherein the visual patterns have different areas on screen ranging from a predetermined fraction of a full screen area of the display device to the full screen area.

3. The method according to claim 2, wherein the single visual pattern having the predetermined fraction of the full screen area is selected when the single message is received for the first time, wherein the single visual pattern having a larger fraction of the full screen area is selected as the number of times the single message was received becomes larger, and wherein the single visual pattern having the full screen area is selected when the number of times the single message was received is equal to or greater than a predetermined number.

4. The method according to claim 1, wherein each of the visual patterns has a rectangular shape to be displayed on screen.

5. The method according to claim 4, wherein the visual patterns have different areas on screen ranging from a predetermined fraction of a full screen area of the display device to the full screen area.

6. The method according to claim 5, wherein the single visual pattern having the predetermined fraction of the full screen area is selected when the single message is received for the first time, wherein the single visual pattern having a larger fraction of the full screen area is selected as the number of times the single message was received becomes larger, and wherein the single visual pattern having the full screen area is selected when the number of times the single message was received is equal to or greater than a predetermined number.

7. The method according to claim 1, wherein the single message is displayed with overlapping the single visual pattern on screen.

8. The method according to claim 1, wherein the single message is displayed without overlapping the single visual pattern on screen.

9. The method according to claim 1, wherein the single message is displayed with the single visual pattern blinking on and off on screen.

10. A method for displaying information on screen in a selective calling receiver having a display device, comprising the steps of:

preparing a predetermined number of visual patterns which are different in area from each other on screen and the predetermined number of different attributes corresponding to the visual patterns, respectively;

counting number of times a single message was received for a predetermined period;

selecting a single visual pattern from the visual patterns and a single attribute corresponding to the single visual pattern according to the number of times the single message was received; and displaying the single message and the single visual pattern according to the single attribute on screen.

11. The method according to claim 10, wherein the visual patterns have different areas on screen ranging from a predetermined fraction of a full screen area of the display device to the full screen area.

12. The method according to claim 11, wherein the single visual pattern having the predetermined fraction of the full screen area is selected when the single message is received for the first time, wherein the single visual pattern having a larger fraction of the full screen area is selected as the number of times the single message was received becomes larger, and wherein the single visual pattern having the full screen area is selected when the number of times the single message was received is equal to or greater than a predetermined number.

13. The method according to claim 10, wherein each of the visual patterns has a rectangular shape to be displayed on screen.

14. The method according to claim 13, wherein the visual patterns have different areas on screen ranging from a predetermined fraction of a full screen area of the display device to the full screen area.

15. The method according to claim 14, wherein the single visual pattern having the predetermined fraction of the full screen area is selected when the single message is received for the first time, wherein the single visual pattern having a larger fraction of the full screen area is selected as the number of times the single message was received becomes larger, and wherein the single visual pattern having the full screen area is selected when the number of times the single message was received is equal to or greater than a predetermined number.

16. The method according to claim 10, wherein the single message is displayed with overlapping the single visual pattern on screen.

17. The method according to claim 10, wherein the single message is displayed without overlapping the single visual pattern on screen.

18. The method according to claim 10, wherein the attributes include different colors from which a single color is selected according to the number of times the single message was received, and wherein the single message is displayed with the single visual pattern of the single color on screen.

19. The method according to claim 10, wherein the single message is displayed with the single visual pattern blinking according to the single attribute on screen.

20. The method according to claim 19, wherein the attributes include different blinking cycles from which a single blinking cycle is selected according to the number of times the single message was received, and wherein the single message is displayed with the single visual pattern blinking in the single cycle on screen.

21. The method according to claim 20, wherein the attributes have different blinking cycles on screen ranging from a first blinking cycle to a second blinking cycle shorter than the first blinking cycle.

22. The method according to claim 21, wherein the single visual pattern having the first blinking cycle is selected when the single message is received for the first time, wherein the single visual pattern having a shorter blinking cycle is selected as the number of times the single message was received becomes larger, and wherein the single visual pattern having the second blinking cycle is selected when the number of times the single message was received is equal to or greater than a predetermined number.

23. The method according to claim 10, wherein the attributes include different colors and different blinking cycles from which a single color and a single blinking cycle are selected according to the number of times the single message was received, and wherein the single message is displayed with the single visual pattern of the single color blinking in the single cycle on screen.

24. The method according to claim 23, wherein the different blinking cycles on screen range from a first blinking cycle to a second blinking cycle shorter than the first blinking cycle.

25. The method according to claim 24, wherein the single visual pattern having the first blinking cycle is selected when the single message is received for the first time, wherein the single visual pattern having a shorter blinking cycle is selected as the number of times the single message was received becomes larger, and wherein the single visual pattern having the second blinking cycle is selected when the number of times the single message was received is equal to or greater than a predetermined number.

26. The method according to claim 1, wherein the visual patterns have three different areas on screen consisting of one-eighth of the full screen area, one-half of the full screen area, and the full screen area.

27. The method according to claim 10, wherein the visual patterns have throe different areas on screen consisting of one-eighth of the full screen area, one-half of the full screen area, and the full screen area.

28. A selective calling receiver having a display device for displaying information on screen, comprising:

receiving means for receiving a selective calling signal and detecting a message from the selective calling signal;

storage means for storing data of a plurality of visual patterns which are different in area from each other on screen;

counting means for counting number of times a single message was received for a predetermined period;

selecting means for selecting a single visual pattern from the visual patterns according to the number of times the single message was received for the predetermined period; and display control means for displaying the single message with the single visual pattern on screen.

29. The selective calling receiver according to claim 28, wherein the visual patterns have different areas on screen ranging from a predetermined fraction of a full screen area of the display device to the full screen area.

30. The selective calling receiver according to claim 29, wherein the single visual pattern having the predetermined fraction of the full screen area is selected when the single message is received for the first time, wherein the single visual pattern having a larger fraction of the full screen area is selected as the number of times the single message was received becomes larger, and wherein the single visual pattern having the full screen area is selected when the number of times the single message was received is equal to or greater than a predetermined number.

31. The method according to claim 1, wherein each of the visual patterns has a rectangular shape to be displayed on screen.

32. A selective calling receiver having a display device for displaying information on screen, comprising:

receiving means for receiving a selective calling signal and detecting a message from the selective calling signal;

storage means for storing data of a predetermined number of visual patterns which are different in area from each other on screen and the predetermined number of different attributes corresponding to the visual patterns, respectively;

counting means for counting number of times a single message was received for a predetermined period;

selecting means for selecting a single visual pattern from the visual patterns and a single attribute corresponding to the single visual pattern according to the number of times the single message was received; and display control means for displaying the single message and the single visual pattern according to the single attribute on screen.

33. The selective calling receiver according to claim 32, wherein the visual patterns have different areas on screen ranging from a predetermined fraction of a full screen area of the display device to the full screen area.

34. The selective calling receiver according to claim 33, wherein the single visual pattern having the predetermined fraction of the full screen area is selected when the single message is received for the first time, wherein the single visual pattern having a larger fraction of the full screen area is selected as the number of times the single message was received becomes larger, and wherein the single visual pattern having the full screen area is selected when the number of times the single message was received is equal to or greater than a predetermined number.

35. The selective calling receiver according to claim 32, wherein each of the visual patterns has a rectangular shape to be displayed on screen.

36. The selective calling receiver according to claim 32, wherein the attributes include different colors from which a single color is selected according to the number of times the single message was received, and wherein the single message is displayed with the single visual pattern of the single color on screen.

37. The selective calling receiver according to claim 32, wherein the single message is displayed with the single visual pattern blinking according to the single attribute on screen.

38. The selective calling receiver according to claim 37, wherein the attributes include different blinking cycles from which a single blinking cycle is selected according to the number of times the single message was received, and wherein the single message is displayed with the single visual pattern blinking in the single cycle on screen.

39. The selective calling receiver according to claim 38, wherein the attributes have different blinking cycles on screen ranging from a first blinking cycle to a second blinking cycle shorter than the first blinking cycle.

40. The selective calling receiver according to claim 39, wherein the single visual pattern having the first blinking cycle is selected when the single message is received for the first time, wherein the single visual pattern having a shorter blinking cycle is selected as the number of times the single message was received becomes larger, and wherein the single visual pattern having the second blinking cycle is selected when the number of times the single message was received is equal to or greater than a predetermined number.

41. The selective calling receiver according to claim 32, wherein the attributes include different colors and different blinking cycles from which a single color and a single blinking cycle are selected according to the number of times the single message was received, and wherein the single message is displayed with the single visual pattern of the single color blinking in the single cycle on screen.

42. The selective calling receiver according to claim 41, wherein the different blinking cycles on screen range from a first blinking cycle to a second blinking cycle shorter than the first blinking cycle.

43. The selective calling receiver according to claim 42, wherein the single visual pattern having the first blinking cycle is selected when the singlemessage is received for the first time, wherein the single visual pattern having a shorter blinking cycle is selected as the number of times the single message was received becomes larger, and wherein the single visual pattern having the second blinking cycle is selected when the number of times the single message was received is equal to or greater than a predetermined number.

44. The selective calling receiver according to claim 28, wherein the visual patterns have three different areas on screen consisting of one-eighth of the full screen area, one-half of the full screen area, and the full screen area.

45. The selective calling receiver according to claim 32, wherein the visual patterns have three different areas on screen consisting of one-eighth of the full screen area, one-half of the full screen area, and the full screen area.

* * * * *